US007937003B2

(12) United States Patent
Yoshida

(10) Patent No.: US 7,937,003 B2
(45) Date of Patent: May 3, 2011

(54) IMAGE FORMING APPARATUS AND METHOD OF DETERMINING DEGRADATION OF CHARGING PROPERTY OF DEVELOPER

(75) Inventor: Yukimasa Yoshida, Nagoya (JP)

(73) Assignee: Brother Kogyo Kabushiki Kaisha, Nagoya-shi (JP)

( * ) Notice: Subject to any disclaimer, the term of this patent is extended or adjusted under 35 U.S.C. 154(b) by 941 days.

(21) Appl. No.: 11/519,096

(22) Filed: Sep. 12, 2006

(65) Prior Publication Data

US 2007/0077076 A1 Apr. 5, 2007

(30) Foreign Application Priority Data

Sep. 30, 2005 (JP) ..... 2005-286455

(51) Int. Cl.
*G03G 15/08* (2006.01)

(52) U.S. Cl. ..... 399/27; 399/29

(58) Field of Classification Search ..... 399/27, 399/29, 51, 55

See application file for complete search history.

(56) References Cited

U.S. PATENT DOCUMENTS

| | | | | |
|---|---|---|---|---|
| 5,182,604 | A * | 1/1993 | Asai | |
| 6,917,780 | B2 | 7/2005 | Ozawa et al. | |
| 7,062,180 | B2 | 6/2006 | Suzuki | |
| 2005/0123311 | A1 * | 6/2005 | Kim et al. | 399/27 |

FOREIGN PATENT DOCUMENTS

| | | |
|---|---|---|
| JP | 06-043719 | 2/1994 |
| JP | 10-186861 | 7/1998 |
| JP | 11-002952 | 1/1999 |
| JP | 11-119520 | 4/1999 |
| JP | 2001-134093 | 5/2001 |
| JP | 2003015380 | 1/2003 |
| JP | 2003156925 | 5/2003 |
| JP | 2003207983 | 7/2003 |
| JP | 2004-240226 | 8/2004 |
| JP | 2005-265956 | 9/2005 |

OTHER PUBLICATIONS

Japanese Office Action for Patent Application No. 2005-286455 mailed Jun. 23, 2009.

Japanese Office Action for Patent Application No. 2005-286455, Mailing date Dec. 16, 2008.

Japanese Office Action for Application No. 2005-286455 mailed Oct. 13, 2009.

* cited by examiner

*Primary Examiner* — David M Gray
*Assistant Examiner* — Laura K Roth
(74) *Attorney, Agent, or Firm* — Banner & Witcoff, Ltd.

(57) ABSTRACT

A photosensitive layer of a photosensitive drum is charged and a surface of the photosensitive layer is exposed at a specified density and then a development bias is applied to a development roller. An absolute value of a detection voltage is obtained from a development current sensor. It is determined whether the obtained absolute value of the detection voltage is less than a threshold which is set in advance, whereby a determination is made as to whether the charging property of toner is degraded.

12 Claims, 13 Drawing Sheets

IMAGE FORMING APPARATUS AND METHOD OF DETERMINING DEGRADATION OF CHARGING PROPERTY OF DEVELOPER

CROSS-REFERENCE TO RELATED APPLICATIONS

This Nonprovisional application claims priority under 35 U.S.C. §119(a) on Patent Application No. 2005-286455 filed in Japan on Sep. 30, 2005, the entire contents of which are hereby incorporated by reference.

BACKGROUND

The present invention relates to an image forming apparatus that forms an image using a developer having a charging property.

Conventionally, in a laser printer, generally, light is irradiated onto a charged photosensitive element to expose a surface of the photosensitive element, and an electrostatic latent image is formed on the surface of the photosensitive element. Then, charged toner is adhered to the electrostatic latent image and thereby the electrostatic latent image is developed as a toner image. The developed toner image is transferred onto a sheet and an image is formed on the sheet.

In the laser printer, within a development unit that allows toner to be adhered to an electrostatic latent image, the toner is triboelectrically charged while the toner is agitated. Thus, every time the laser printer is used, toner remained in the development unit is damaged and as a result the charging property of the toner is degraded over time (see FIG. 1).

In view of this, there is a laser printer that adds up the frequencies of use of the laser printer (e.g., the number of printed sheets or the driving hours of a development unit) and determines, based on a result of the adding up, degradation of the charging property of toner (see Japanese Patent Application Laid-Open No. 10-186861(1998), for example).

SUMMARY

In a conventional laser printer, toner is agitated even when an image is not formed and thus it cannot always be said that the degradation of the toner corresponds to the frequencies of use of the laser printer. In addition, toner is damaged not only by friction in a development unit but also by ambient atmosphere (temperature, humidity, etc.).

In the aforementioned conventional determination method, agitation performed when an image is not formed and damage caused by ambient atmosphere are not considered. Hence, despite the fact that the charging property of toner is actually degraded, it may be mistakenly determined that the charging property is not degraded.

In view of the foregoing and other problems, an object is therefore to provide an image forming apparatus capable of determining with high accuracy that the charging property of a developer is degraded, and a method of determining degradation of the charging property of a developer.

A first aspect is directed to an image forming apparatus including a photosensitive element; a charging unit that charges the photosensitive element; an exposing unit that irradiates light onto a surface of the photosensitive element charged by the charging unit to expose the surface of the photosensitive element and forms an electrostatic latent image on the surface of the photosensitive element; a developing unit that allows a developer having a charging property to be adhered to a development member that comes into contact with the surface of the photosensitive element, and applies to the development member a development bias to form, between the development member and the surface of the photosensitive element, an electric field in a direction in which the developer is adhered to the electrostatic latent image, whereby the developer is adhered to the electrostatic latent image and the electrostatic latent image is developed as a developer image; and a transferring unit that transfers the developer image onto a recording medium and forms an image on the recording medium. The image forming apparatus comprises: an exposure instructing unit that allows the exposing unit to perform exposure on the surface of the charged photosensitive element at a specified density which is specified in advance; a measuring unit that measures a magnitude of a current that flows between the photosensitive element and the development member; and a degradation determining unit that determines that a charging property of the developer is degraded when a value measured by the measuring unit is less than a first threshold which is set in advance or is equal to or less than the first threshold.

In the image forming apparatus, the charging unit charges the photosensitive element and the exposing unit irradiates light onto a surface of the charged photosensitive element to expose the surface of the photosensitive element and an electrostatic latent image is formed on the surface of the photosensitive element. Subsequently, the development unit applies a development bias to a development member that comes into contact with the surface of the photosensitive element, to allow a developer having a charging property to be adhered to the development member. In addition, the development unit forms, between the development member and the surface of the photosensitive element, an electric field in a direction in which the developer is adhered to the electrostatic latent image, whereby the developer is adhered to the electrostatic latent image and the electrostatic latent image is developed as a developer image. Then, the transfer unit transfers the developer image onto a recording medium and an image is formed on the recording medium.

Meanwhile, the exposure instructing unit allows the exposing unit to perform exposure on the surface of the charged photosensitive element at a specified density which is specified in advance. The measuring unit measures a magnitude of a current that flows between the photosensitive element and the development member. When the measured value is less than the first threshold or is equal to or less than the first threshold, the degradation determining unit determines that the charging property of the developer is degraded.

In the image forming apparatus, when a charged developer is adhered to an electrostatic latent image from the development member, a current resulting from movement of the charged developer flows between the photosensitive element and the development member. When the charging property of the developer is not degraded, such an amount of the charged developer that corresponds to the specified density is adhered to the electrostatic latent image. Thus, the magnitude of the current flowing between the photosensitive element and the development member corresponds to the specified density.

When the charging property of the developer is degraded, however, only such an amount of the developer that is lower than the amount corresponding to the specified density is adhered to the electrostatic latent image. Thus, the magnitude of the current flowing between the photosensitive element and the development member is smaller than that corresponding to the specified density.

Even when the specified density is low and a current that flows between the photosensitive element and the development member resulting from a potential difference between a charging potential of the photosensitive element and a development bias is greater than the current resulting from movement of the developer (i.e., the proportion of a non-exposed portion is high), the developer acts as electrical resistance. When the charging property of the developer is degraded, the electrical resistance increases. Thus, the magnitude of the current flowing between the photosensitive element and the development member (current resulting from the development bias) is smaller than that corresponding to the specified density.

Namely, in the image forming apparatus, by using a developer whose discharging property is not degraded, the magnitude of a current that flows between the photosensitive element and the development member according to the specified density is measured in advance. Then, by setting the measured magnitude as the first threshold, a determination that the charging property of the developer is degraded can be made with high accuracy. Alternatively, by using a developer whose discharging property is degraded, the magnitude of a current that flows between the photosensitive element and the development member according to the specified density is measured in advance. Then, even by setting the measured magnitude as the first threshold, a determination that the charging property of the developer is degraded can be made with high accuracy.

According to the first aspect, an image forming apparatus capable of determining with high accuracy that the charging property of a developer is degraded can be provided.

Note that the "specified density" represents a certain rate (density) at which exposure is performed on a certain size region of the surface of the photosensitive element (the same applies hereinafter). The "magnitude of a current" does not include the direction of the current and represents an absolute value (the same applies hereinafter). The measuring unit may measure the magnitude of a current as a voltage value or as a current value.

A second aspect is directed to a method of determining degradation of a charging property of a developer comprising: a charging step of charging a photosensitive element; an exposing step of exposing a surface of the charged photosensitive element at a specified density which is specified in advance, and forming an electrostatic latent image on the surface; a bias applying step of allowing a developer having a charging property to be adhered to a development member that comes into contact with the surface of the photosensitive element, and applying to the development member a development bias to form, between the development member and the surface of the photosensitive element, an electric field in a direction in which the developer is adhered to the electrostatic latent image; a measuring step of measuring a magnitude of a current that flows between the photosensitive element and the development member; and a degradation determining step of determining whether a measurement result in the measuring step is less than a first threshold which is set in advance or is equal to or less than the first threshold, and determining that a charging property of the developer is degraded when the measurement result is less than the first threshold or is equal to or less than the first threshold.

In such a method of determining degradation of a charging property, first, in the charging step, a photosensitive element is charged. In the exposing step, a surface of the charged photosensitive element is exposed at a specified density and an electrostatic latent image is formed on the surface of the photosensitive element. Subsequently, in the bias applying step, a development bias is applied to a development member that comes into contact with the surface of the photosensitive element to allow a developer having a charging property to be adhered to the development member, and an electric field in a direction in which the developer is adhered to the electrostatic latent image is formed between the development member and the surface of the photosensitive element. Then, in the measuring step, the magnitude of a current that flows between the photosensitive element and the development member is measured. In the degradation determining step, it is determined whether a measurement result in the measuring step is less than the first threshold or is equal to or less than the first threshold, and when the measurement result is less than the first threshold or is equal to or less than the first threshold, it is determined that the charging property of the developer is degraded.

That is, the second aspect is a method of determining degradation of a charging property in the first aspect. In the second aspect, as with the first aspect, a determination that the charging property of a developer is degraded can be made with high accuracy.

The above and further objects and features of the invention will more fully be apparent from the following detailed description with accompanying drawings.

DETAILED DESCRIPTION OF THE EXEMPLARY EMBODIMENTS

The present invention will be described in detail below with reference to the drawings showing embodiments thereof. It is to be understood that the following embodiments are merely examples and, needless to say, the embodiments can be appropriately changed without departing from the spirit and scope of the present invention.

First Embodiment

Figure 1:
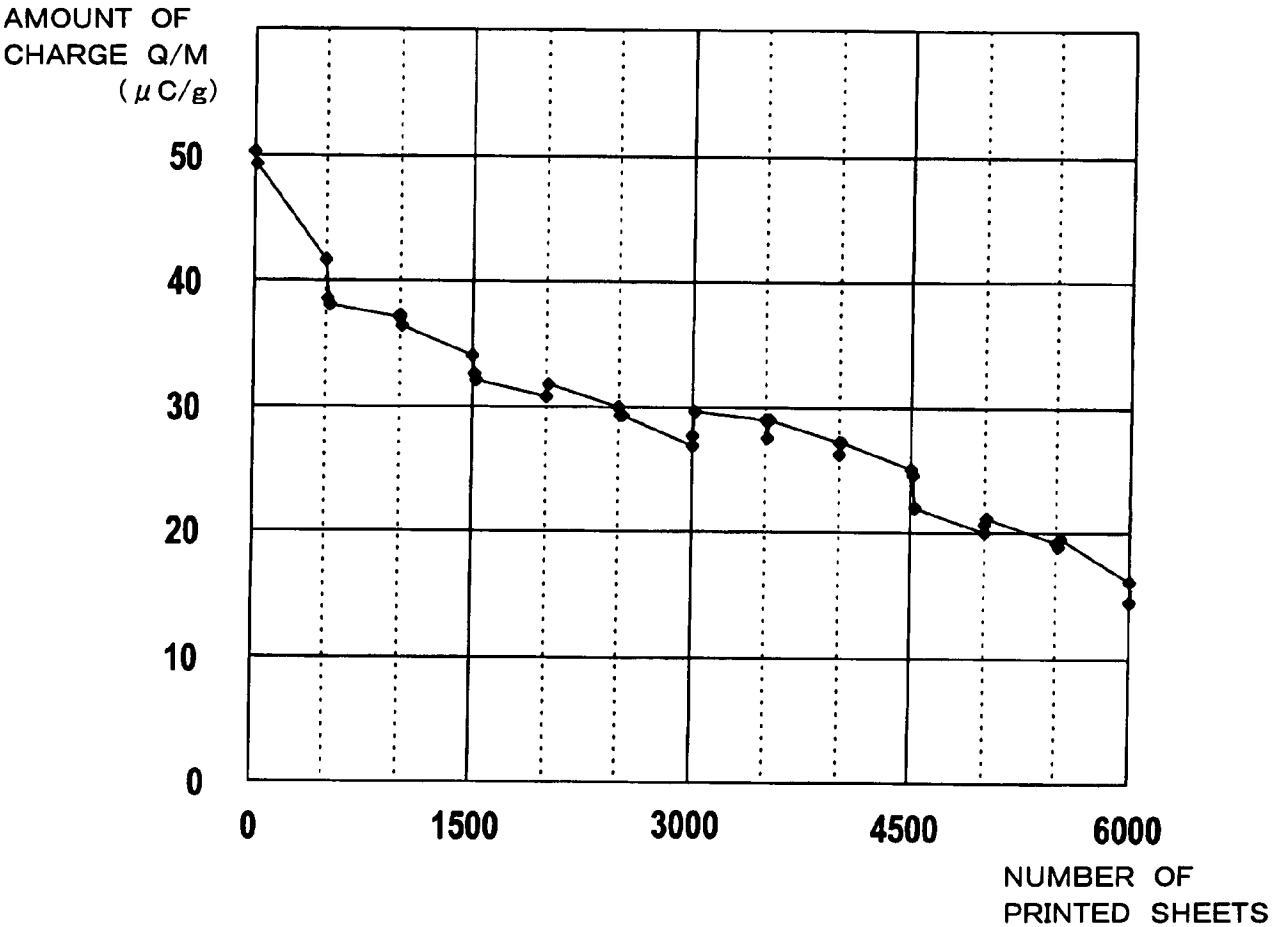
FIG. 1 PRIOR ART
FIG. 1 is a graph showing an example of degradation of a charging property of toner.
Figure 2:
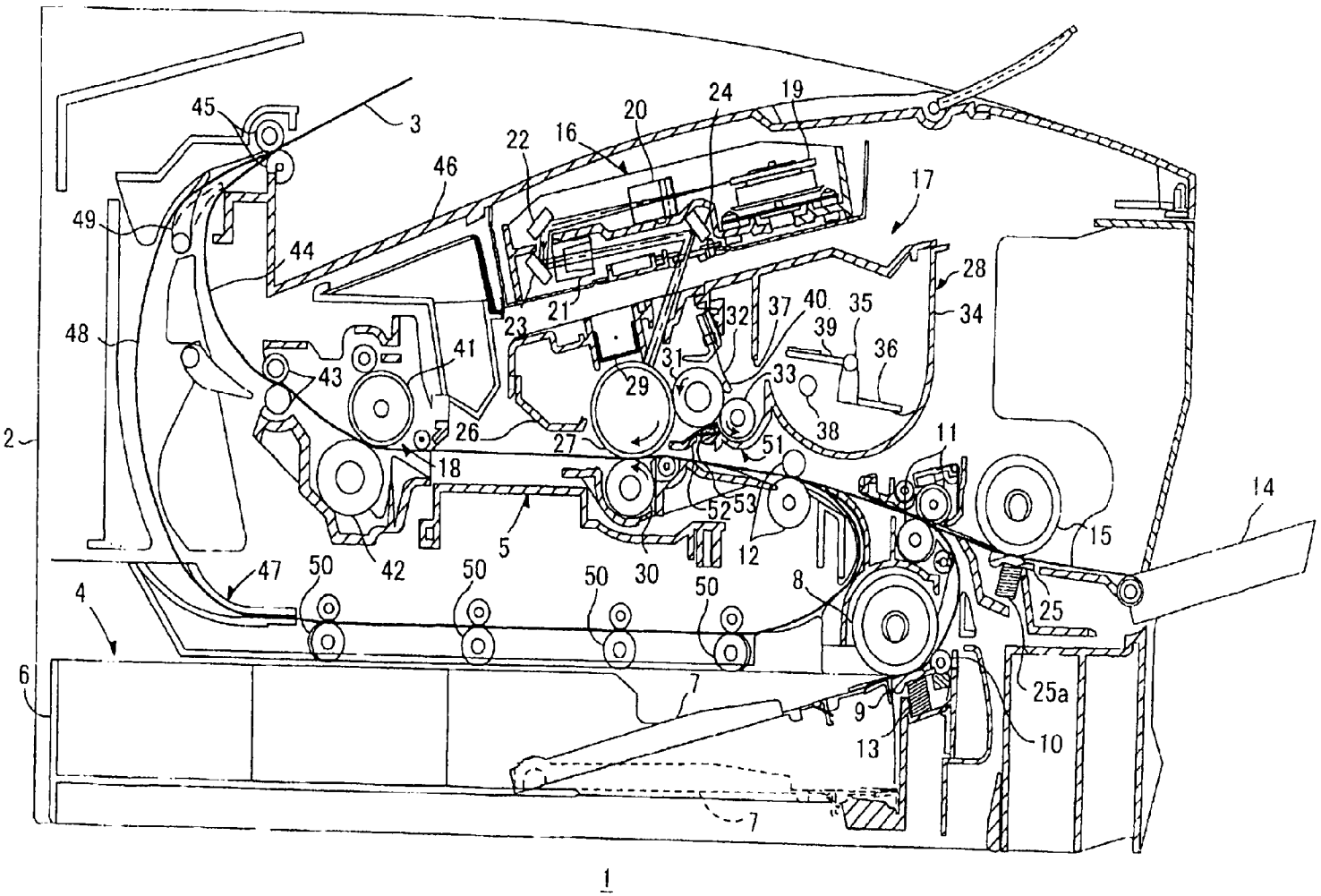
FIG. 2 is a cross-sectional side view of a laser printer.

First, a mechanical configuration of a laser printer 1 to which the present invention is applied will be described using FIG. 2. FIG. 2 is a cross-sectional side view of the laser printer 1. As shown in FIG. 2, the laser printer 1 includes, in a body casing 2, a feeder unit 4 used to feed a sheet 3, an image forming unit 5 used to form a predetermined image on the fed sheet 3, and the like.

The feeder unit 4 includes, in a bottom of the body casing 2, a feed tray 6 which is removably installed; a sheet pressing plate 7 provided in the feed tray 6; a feed roller 8 and a feed pad 9 which are provided above an edge on one side of the feed tray 6; paper dust removing rollers 10 and 11 provided on the downstream side of the feed roller 8 in a transport direction of the sheet 3; and registration rollers 12 provided on the downstream side of the paper dust removing rollers 10 and 11 in the transport direction of the sheet 3.

The sheet pressing plate 7 allows sheets 3 to be stacked in a multilayer structure. The sheet pressing plate 7 is swingably supported at its end furthest from the feed roller 8 so that an end of the sheet pressing plate 7 nearest the feed roller 8 can move in a vertical direction. In addition, the sheet pressing plate 7 is biased in an upward direction from its backside by a spring which is not shown. Hence, as the amount of stacked sheets 3 increases, the sheet pressing plate 7 swings in a downward direction against the biasing force of the spring with the end furthest from the feed roller 8 acting as a fulcrum.

The feed roller 8 and the feed pad 9 are arranged so as to face each other. By a spring 13 arranged on a backside of the feed pad 9, the feed pad 9 is pressed toward the feed roller 8. Specifically, the top sheet 3 on the sheet pressing plate 7 is pressed toward the feed roller 8 from the backside of the sheet pressing plate 7 by the spring which is not shown, and by rotation of the feed roller 8 the top sheet 3 is sandwiched between the feed roller 8 and the feed pad 9 and then fed one by one. Then, the fed sheet 3 is subjected to paper dust removal by the paper dust removing rollers 10 and 11 and then transported to the registration rollers 12. The registration rollers 12 are composed of a pair of rollers for performing predetermined registration on the sheet 3 and then transporting the sheet 3 to the image forming unit 5.

Furthermore, the feeder unit 4 includes a multipurpose tray 14, a multipurpose feed roller 15 used to feed sheets 3 to be stacked on the multipurpose tray 14, and a multipurpose feed pad 25. The multipurpose feed roller 15 and the multipurpose feed pad 25 are arranged so as to face each other. By a spring 25*a* arranged on a backside of the multipurpose feed pad 25, the multipurpose feed pad 25 is pressed toward the multipurpose feed roller 15. Specifically, sheets 3 to be stacked on the multipurpose tray 14 are sandwiched, one by one, between the multipurpose feed roller 15 and the multipurpose feed pad 25 by rotation of the multipurpose feed roller 15 and then fed one by one.

The image forming unit 5 includes a scanner unit 16, a process unit 17, a fixing unit 18, and the like. The scanner unit 16 is provided in an upper part of the body casing 2. The scanner unit 16 includes a laser emitting unit (not shown), a polygon mirror 19 which is rotated and driven, lenses 20 and 21, reflecting mirrors 22, 23, and 24, and the like. Specifically, the scanner unit 16 is configured such that a laser beam emitted from the laser emitting unit based on predetermined image data passes through or is reflected by the polygon mirror 19, the lens 20, the reflecting mirrors 22 and 23, the lens 21, and the reflecting mirror 24 in this order, as shown by a dash-dotted line, and then irradiated onto a surface of a photosensitive drum 27 in the process unit 17. The scanner unit 16 scans the laser beam along a direction of a rotating shaft of the photosensitive drum 27.

The process unit 17 is arranged below the scanner unit 16. The process unit 17 includes, in a drum cartridge 26 which is removably installed to the body casing 2, the photosensitive drum 27; a development cartridge 28; a scorotron charger (hereinafter simply referred to as the "charger") 29; and a transfer roller 30. The development cartridge 28 is removable from the drum cartridge 26. The development cartridge 28 includes a development roller 31, a layer thickness regulating blade 32, a supply roller 33, a toner container 34, and the like.

In the toner container 34, positive charging non-magnetic single-component toner is filled as a developer. For the toner, a polymerized monomer, for example, polymerized toner is used which is obtained by copolymerizing, by known polymerization methods such as suspension polymerization, styrene monomers such as styrene or acrylic monomers such as acrylic acid, alkyl (C1 to C4) acrylate, and alkyl (C1 to C4) metaacrylate. Such polymerized toner has spherical particles with a diameter of the order of 6 to 10 micrometers and has excellent fluidity and thus can form high-quality images. In addition, a colorant, such as carbon black, and a wax, for example, are mixed in such toner and also an external additive such as silica is added to such toner to improve fluidity.

In the toner container 34, the toner is agitated by rotation (clockwise rotation direction in the drawing) of an agitator 36 which is supported by a rotating shaft 35 provided in the center of the toner container 34. The toner is discharged from a toner supply opening 37 which is opened in a side of the toner container 34. A window 38 for detecting the amount of remaining toner is provided in a side wall of the toner container 34 and the window 38 is cleaned with a cleaner 39 supported by the rotating shaft 35.

The supply roller 33 is pivoted at a lateral location of the toner supply opening 37 so as to be rotatable in a direction shown by an arrow in the drawing (counterclockwise direction in the drawing). Furthermore, the development roller 31 is pivoted facing the supply roller 33 so as to be rotatable in a direction shown by an arrow in the drawing (counterclockwise direction in the drawing). The supply roller 33 and the development roller 31 are arranged such that their outer surfaces abut each other.

The supply roller 33 is made by covering a metal roller shaft by a roller made of a conductive foam material. The development roller 31 is made by covering a metal roller shaft by a roller made of an elastic material which is a conductive rubber material. More specifically, the roller of the development roller 31 is such that a coating layer of urethane rubber or silicone rubber that contains fluorine is coated on a surface of a roller body made of conductive urethane rubber or silicone rubber that contains carbon particles or the like.

The layer thickness regulating blade 32 includes a pressing unit 40 with a semicircular cross section which is made of insulating silicone rubber and provided at a tip of a blade body made of a metal blade spring material. The layer thickness regulating blade 32 is supported by a casing 51 of the development cartridge 28 at a location near the development roller 31. The pressing unit 40 is pressed against the outer surface of the development roller 31 by the elastic force of the blade body.

In the development cartridge 28 thus configured, toner discharged from the toner supply opening 37 is supplied to the development roller 31 by rotation of the supply roller 33. At this time, the toner is triboelectrically charged to a positive polarity between the supply roller 33 and the development roller 31. Then, the toner supplied on the development roller 31 enters, by rotation of the development roller 31, a space between the pressing unit 40 of the layer thickness regulating blade 32 and the development roller 31. Here the toner is further sufficiently triboelectrically charged and then supported on the development roller 31 as a thin layer of a uniform thickness.

The photosensitive drum 27 is pivoted at a lateral location of the development roller 31 so as to be rotatable in a direction shown by an arrow in the drawing (clockwise direction in the drawing) such that an outer surface of a body of the photosensitive drum 27 abuts the outer surface of the development roller 31. The rotating shaft and body of the photosensitive drum 27 are made of conductive materials (e.g., aluminum) and the body is electrically connected to the body casing 2 via the rotating shaft (i.e., casing grounded). In addition, a photosensitive layer having a positive charging property which is formed of polycarbonate or the like is formed on the outer surface of the body.

The charger 29 is arranged above the photosensitive drum 27 with a predetermined space therebetween so as to prevent the charger 29 from coming into contact with the outer surface of the photosensitive drum 27. The charger 29 is a positive charging scorotron type charger that generates corona discharge from a charging wire of tungsten or the like. The charger 29 charges the outer surface of the photosensitive drum 27 to a positive polarity on a certain-region-by-certain-region basis.

The transfer roller 30 is arranged below the photosensitive drum 27 so as to face the photosensitive drum 27. The transfer roller 30 receives a driving force (frictional force) from the photosensitive drum 27 and is pivoted so as to be rotatable in a direction shown by an arrow in the drawing (counterclockwise direction in the drawing). Specifically, the transfer roller 30 brings in a sheet 3 transported from the registration rollers 12, between the transfer roller 30 and the photosensitive drum 27 and transports the sheet 3 to the downstream side in a transport direction of the sheet 3. The transfer roller 30 is made by covering a metal roller shaft by a roller made of a conductive rubber material.

The fixing unit 18 is arranged on the lateral downstream side of the process unit 17. The fixing unit 18 includes a heating roller 41, a pressing roller 42 that presses the heating roller 41, and a pair of transport rollers 43 provided on the downstream side of the heating roller 41 and the pressing roller 42. The heating roller 41 includes therein a heating halogen lamp. The heating roller 41 allows toner transferred onto a sheet 3 in the process unit 17 to be heat-fixed while the sheet 3 passes between the heating roller 41 and the pressing roller 42. The pair of transport rollers 43 bring in the sheet 3 passed between the heating roller 41 and the pressing roller 42, between the transports rollers 43 and transport the sheet 3 to a sheet discharge path 44. The sheet 3 transported to the sheet discharge path 44 is brought in between a pair of sheet discharge rollers 45 and then discharged, by the pair of sheet discharge rollers 45, onto a sheet discharge tray 46.

The laser printer 1 further includes an inverse transport unit 47 to form images on both sides of a sheet 3. The inverse transport unit 47 includes the sheet discharge rollers 45, an inverse transport path 48, a flapper 49, and a plurality of inverse transport rollers 50.

The sheet discharge rollers 45 are composed of a pair of rollers. When a sheet 3 is discharged onto the sheet discharge tray 46, the pair of rollers are rotated and driven forward (i.e., the upper roller is in the counterclockwise direction in the drawing and the lower roller is in the clockwise direction in the drawing). On the other hand, when a sheet 3 is inverted, the pair of rollers are rotated and driven backwards (i.e., the upper roller is in the clockwise direction in the drawing and the lower roller is in the counterclockwise direction in the drawing). The inverse transport path 48 is disposed along the vertical direction so as to transport a sheet 3 from the sheet discharge rollers 45 to the inverse transport rollers 50 arranged below the image forming unit 5. Specifically, while an upstream side end of the inverse transport path 48 is arranged near the sheet discharge rollers 45, a downstream side end of the inverse transport path 48 is arranged near the inverse transport rollers 50.

The flapper 49 is swingably provided so as to face a branch between the sheet discharge path 44 and the inverse transport path 48. The flapper 49 can switch, by energization or deenergization of solenoid (not shown), the transport direction of a sheet 3 inverted by the sheet discharge rollers 45 from a direction toward the sheet discharge path 44 to a direction toward the inverse transport path 48. The inverse transport rollers 50 are provided above the feed tray 6 in a substantially horizontal direction. While inverse transport rollers 50 provided at the most upstream side are arranged near a rear end of the inverse transport path 48, inverse transport rollers 50 provided at the most downstream side are arranged below the registration rollers 12.

Figure 3:
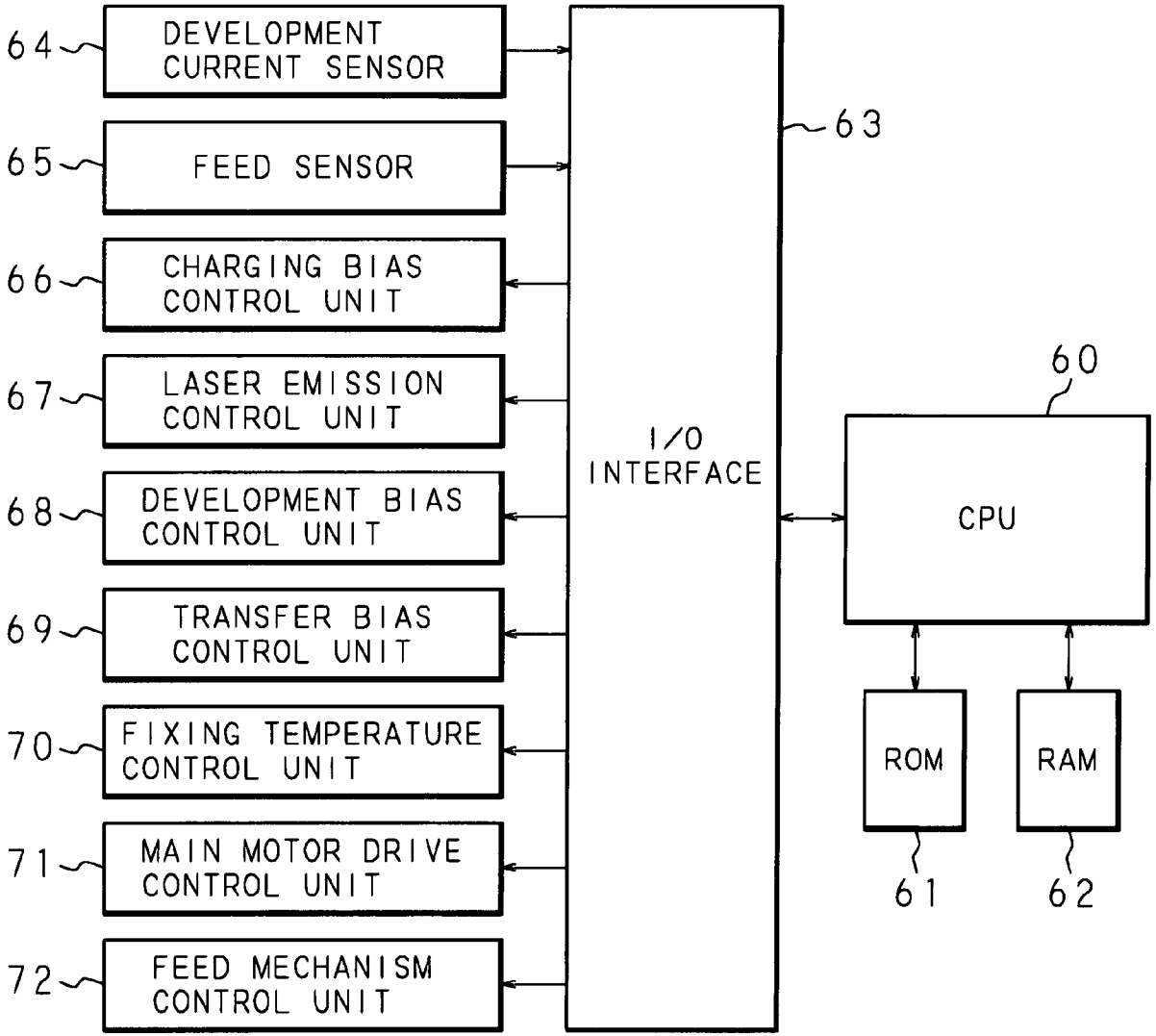
FIG. 3 is a block diagram showing an electrical configuration of the laser printer.

Now, an electrical configuration of the laser printer 1 will be described using FIG. 3. FIG. 3 is a block diagram showing the electrical configuration of the laser printer 1.

As shown in FIG. 3, the laser printer 1 includes a CPU 60 that centralizes control of the laser printer 1. To the CPU 60, are connected a ROM 61 that stores, for example, programs for various processes to be performed by the CPU 60 and parameters that are used in various processes, and a RAM 62 that is used as a storage area when the CPU 60 performs various processes. The CPU 60 performs a plurality of processes parallely in a time division manner (i.e., the CPU 60 is set to be able to perform multitasking).

To the CPU 60, are connected via an I/O interface 63 a development current sensor 64, a feed sensor 65, a charging bias control unit 66, a laser emission control unit 67, a development bias control unit 68, a transfer bias control unit 69, a fixing temperature control unit 70, a main motor drive control unit 71, and a feed mechanism control unit 72.

The feed sensor 65 is arranged near the downstream side of the registration rollers 12 (see FIG. 2). The feed sensor 65 sets a detection signal to ON while detecting a sheet 3, and sets a detection signal to OFF while not detecting a sheet 3. That is, the change in a detection signal from OFF to ON indicates that the feed sensor 65 detects a leading edge of a sheet 3, and the change in a detection signal from ON to OFF indicates that the feed sensor 65 detects a trailing edge of the sheet 3.

The charging bias control unit 66 turns the charger 29 on/off in response to an instruction from the CPU 60. More specifically, in response to an instruction from the CPU 60, the charging bias control unit 66 applies a charging bias (e.g., +5 kilovolts to +7 kilovolts) which is a voltage to charge the photosensitive layer of the photosensitive drum 27, to the charging wire in the charger 29 and thereby turns the charger 29 on. In addition, in response to an instruction from the CPU 60, the charging bias control unit 66 cancels the charging bias (i.e., sets the charging bias to 0 volt) and thereby turns the charger 29 off. When a charging bias is applied to the charging wire, by a grid electrode the photosensitive layer of the photosensitive drum 27 is charged to a certain potential (e.g., +800 volts).

The laser emission control unit 67 controls, in response to an instruction from the CPU 60, the operation of a laser generator or the rotation of the polygon mirror 19 in the scanner unit 16 to control irradiation of a laser beam, whereby an electrostatic latent image (e.g., +150 volts) is formed on the surface of the photosensitive layer (e.g., +800 volts) of the charged photosensitive drum 27.

The development bias control unit 68 controls, in response to an instruction from the CPU 60, a voltage to be applied to the development roller 31 and the supply roller 33. More specifically, in response to an instruction from the CPU 60, the development bias control unit 68 applies to the development roller 31 and the supply roller 33 a development bias (e.g., +300 volts) which is a voltage to form, between the outer surface of the development roller 31 and the surface of the photosensitive layer of the photosensitive drum 27, an electric field in a direction in which toner adhered to the outer surface of the development roller 31 is adhered to the electrostatic latent image.

The transfer bias control unit 69 controls, in response to an instruction from the CPU 60, a voltage to be applied to the transfer roller 30. More specifically, in response to an instruction from the CPU 60, the transfer bias control unit 69 applies to the transfer roller 30 a forward transfer bias (e.g., 10 microamperes for constant current control) which is a voltage to form, between the outer surface of the transfer roller 30 and the surface of the photosensitive layer of the photosensitive drum 27, an electric field in a direction in which the toner adhered to the electrostatic latent image is adhered to the outer surface of the transfer roller 30. In addition, in response to an instruction from the CPU 60, the transfer bias control unit 69 applies to the transfer roller 30 a backward transfer bias (e.g., +1 kilovolt) which is a voltage to form, between the outer surface of the transfer roller 30 and the surface of the photosensitive layer of the photosensitive drum 27, an electric field in an opposite direction to that of the electric field formed by the forward transfer bias.

The fixing temperature control unit 70 controls, in response to an instruction from the CPU 60, the temperature of the heating roller 41. More specifically, in response to an instruction from the CPU 60, the fixing temperature control unit 70 controls a voltage to be applied to the halogen lamp which is a heat source of the heating roller 41. The main motor drive control unit 71 controls, in response to an instruction from the CPU 60, the driving of a main motor (not shown) which is a driving source of various members (e.g., the photosensitive drum 27 and the heating roller 41) which are rotated and driven in the laser printer 1. The feed mechanism control unit 72 controls, in response to an instruction from the CPU 60, feed mechanisms such as the feed roller 8 or the like.

Figure 4:
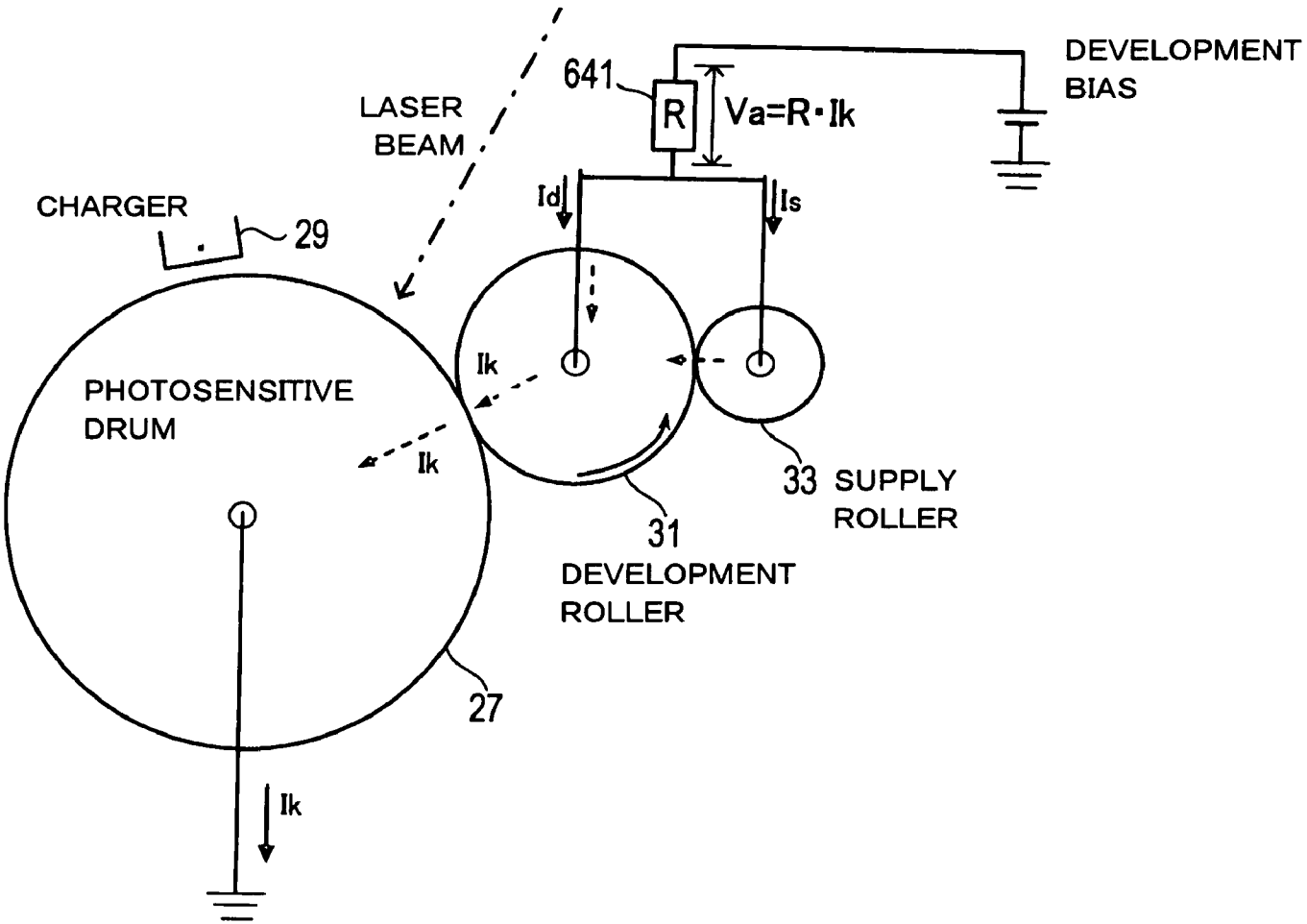
FIG. 4 is an illustrative diagram briefly showing a flow of a development current.

FIG. 4 is an illustrative diagram briefly showing a flow of a development current. As shown in FIG. 4, the development current sensor 64 includes a current-measuring resistor 641 which is connected in series to wiring lines that extend from a supply source of a development bias to the roller shaft of the development roller 31 and to the roller shaft of the supply roller 33. The development current sensor 64 detects a voltage (detection voltage Va) between two ends of the current-measuring resistor 641.

The detection voltage Va can be expressed by the following equation (1) based on Ohm's law:

$$Va = R \cdot Ik \quad (1)$$

where Ik is the development current and R is the electric resistance of the current-measuring resistor 641.

The development current Ik is the sum of a current Is that flows between the supply source of a development bias and the roller shaft of the supply roller 33 and a current Id that flows between the supply source of a development bias and the roller shaft of the development roller 31.

The development current sensor 64 detects a detection voltage Va generated by a development current and outputs an absolute value of the detected detection voltage Va to the CPU 60.

Figure 5A:
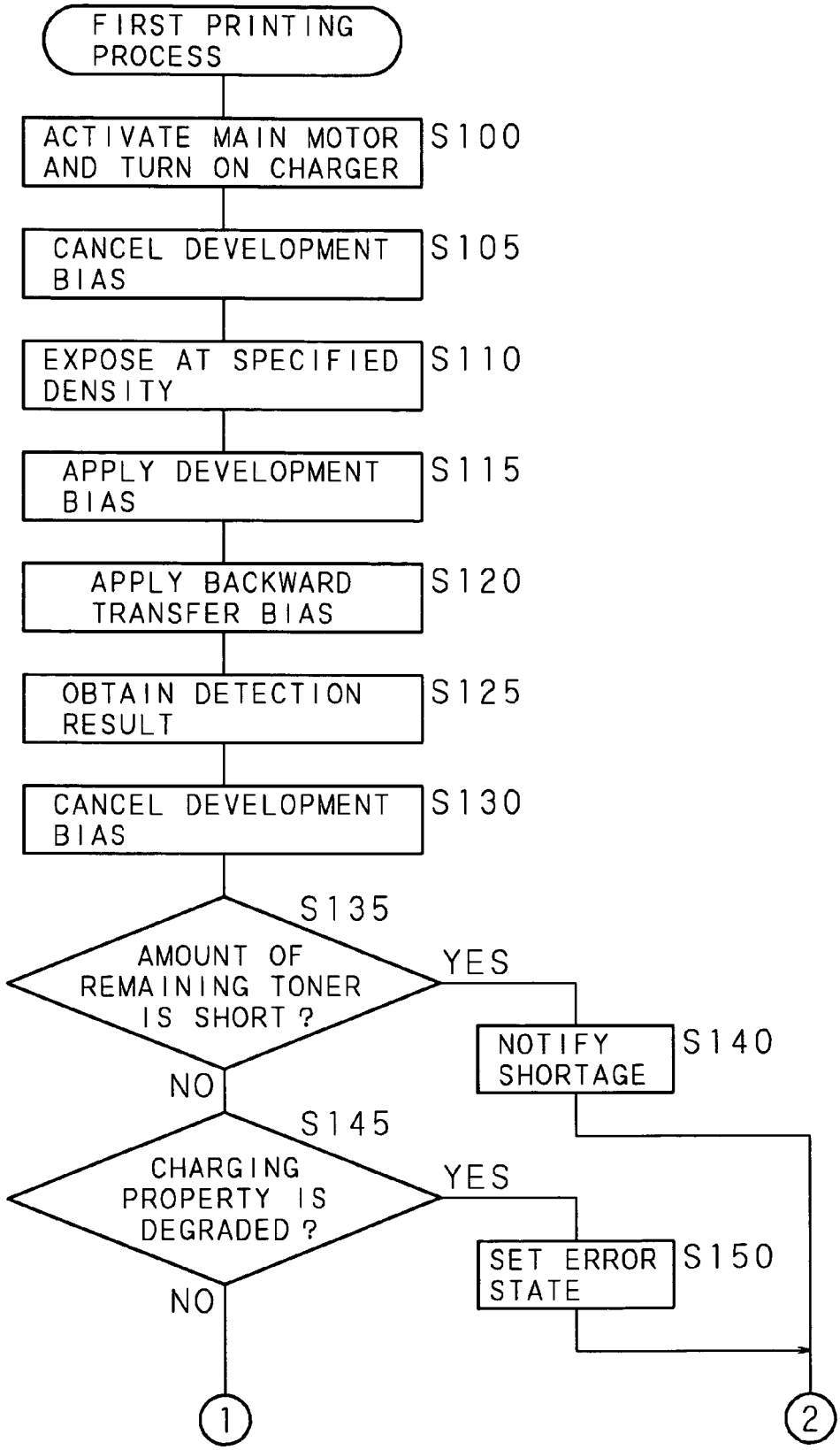
FIGS. 5A and 5B are flowcharts showing a flow of a first printing process.
Figure 5B:
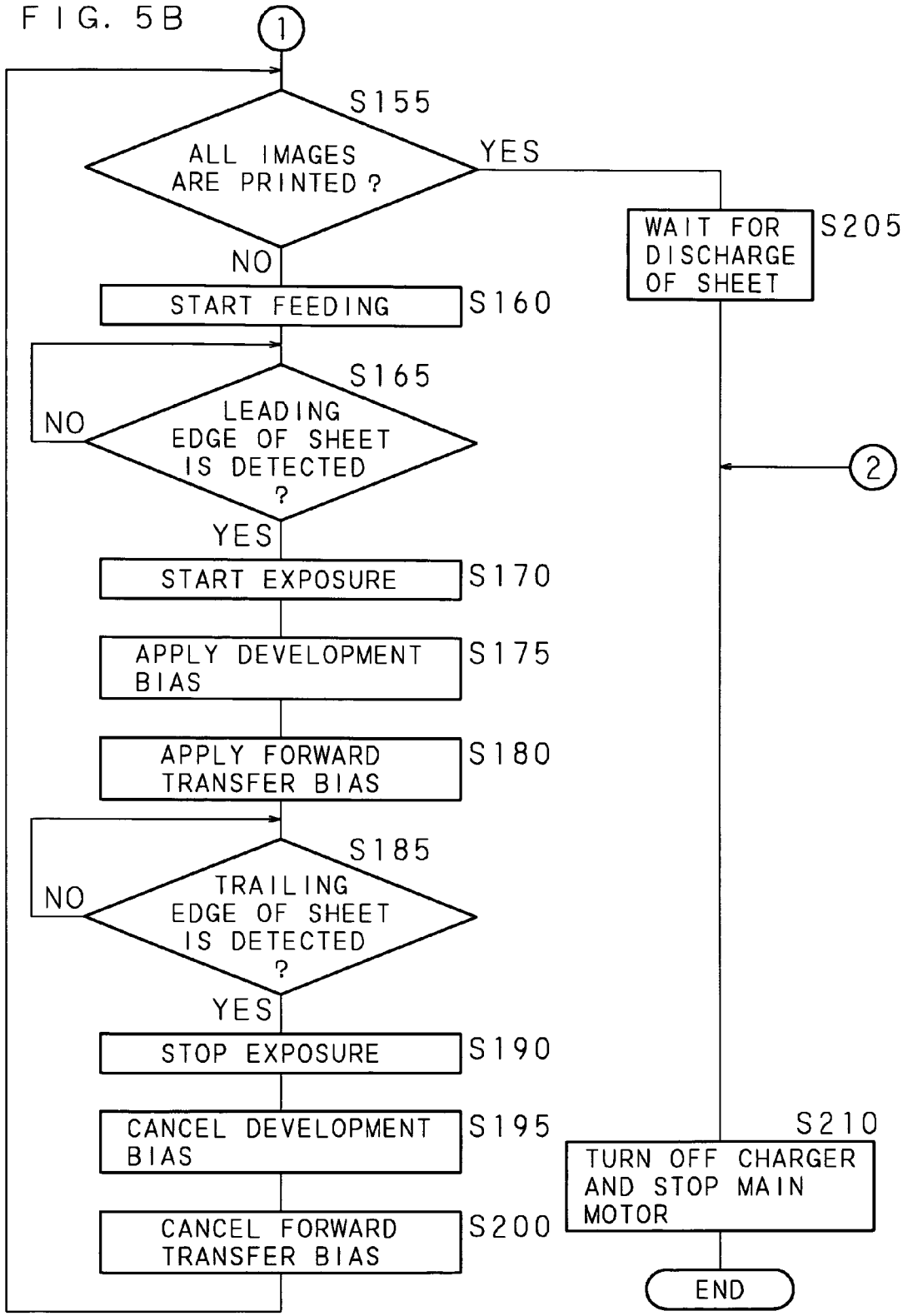

Of various processes performed by the CPU 60, a first printing process which is a process according to the present invention will be described in detail below. FIGS. 5A and 5B are flowcharts showing a flow of the first printing process. The CPU 60 performs this process when receiving image data from an external terminal device.

In the process, first, the CPU 60 instructs the main motor drive control unit 71 to activate the main motor and thereby the main motor is activated, and instructs the charging bias control unit 66 to apply a charging bias and thereby the charger 29 is turned on (S100), whereby the photosensitive layer of the photosensitive drum 27 is charged while the photosensitive drum 27 is rotated.

Subsequently, the CPU 60 instructs the development bias control unit 68 to cancel a development bias (i.e., set a development bias to 0 volt) and thereby a development bias is canceled so that a development bias is not applied to the development roller 31 (S105), whereby matter adhered onto the surface of the photosensitive layer of the photosensitive drum 27 is adhered to the development roller 31 and collected. Namely, toner remained on the surface of the photosensitive layer of the photosensitive drum 27 is charged by the charger 29 to +800 volts and thus the toner can be adhered to the development roller 31 in which a development bias is canceled, and collected.

Then, the CPU 60 instructs the laser emission control unit 67 to perform exposure on a certain size region of the surface of the photosensitive layer of the photosensitive drum 27, at a specified density (here, 100 percent) which is specified in advance, and thereby the surface of the photosensitive layer of the photosensitive drum 27 is exposed at the specified density (S110). After a certain period of time has elapsed after the exposure is started, the CPU 60 instructs the development bias control unit 68 to apply a development bias and thereby a development bias is applied to the development roller 31 (S115), and instructs the transfer bias control unit 69 to apply a backward transfer bias and thereby a backward transfer bias is applied to the transfer roller 30 (S120).

Then, the CPU 60 obtains a detection result (absolute value of a detection voltage Va) by the development current sensor 64 (S125) and stores the obtained detection result in the RAM 62. Here, the detection result is obtained at obtaining timing which is specified in advance. For the obtaining timing, when the region exposed at S110 is the entire surface of the photosensitive layer of the photosensitive drum 27, any timing can be set; however, when the region exposed at S110 is only part of the surface of the photosensitive layer, timing at which the exposed region abuts the outer surface of the development roller 31 is set.

When the obtaining of the detection result is completed, the CPU 60 instructs the development bias control unit 68 to cancel the development bias and thereby the development bias applied to the development roller 31 is canceled (S130), whereby toner remained on the surface of the photosensitive layer of the photosensitive drum 27 is adhered to the development roller 31 and collected.

When the collection of the toner is completed, the CPU 60 determines whether the absolute value of the detection voltage Va which is stored in the RAM 62 at S125 is less than a second threshold which is set in advance in the ROM 61, and thereby determines whether the amount of remaining toner is short (S135). Here, an absolute value of a detection voltage Va which is generated for the specified density when a development bias is applied to the development roller 31 with the amount of remaining toner being short, is measured in advance and the measured value is set in the ROM 61 as the second threshold. Note that the second threshold is smaller than a first threshold which will be described later.

If it is determined that the amount of remaining toner is short ("YES" at S135), the CPU 60 then notifies the external terminal device of the shortage or displays the notification on a display of the laser printer 1 (S140) and proceeds to S210 which will be described later. On the other hand, if it is determined that the amount of remaining toner is not short ("NO" at S135), the CPU 60 then determines whether the absolute value of the detection voltage Va stored in the RAM 62 is less than the first threshold set in advance in the ROM 61, and thereby determines whether the charging property of the toner is degraded (S145). Here, an absolute value of a detection voltage Va which is generated for the specified density when a development bias is applied to the development roller 31 with the charging property of the toner being degraded, is measured in advance and the measured value is set in the ROM 61 as the first threshold.

If it is determined that the charging property of the toner is degraded ("YES" at S145), the CPU 60 then sets an error state in the RAM 62 (S150) and proceeds to S210 which will be described later. On the other hand, if it is determined that the charging property of the toner is not degraded ("NO" at S145), the CPU 60 then determines whether images for the received image data are all printed (S155). If the images are not all printed ("NO" at S155), the CPU 60 then instructs the feed mechanism control unit 72 to allow the feed mechanisms to operate and thereby feeding starts (S160).

After the CPU 60 has waited until the feed sensor 65 detects a leading edge of a sheet 3 ("NO" at S165), when the feed sensor 65 detects a leading edge of a sheet 3 ("YES" at S165), the CPU 60 instructs the laser emission control unit 67 to perform exposure according to the image data and thereby exposure starts (S170). After a certain period of time has elapsed after the exposure is started, the CPU 60 instructs the development bias control unit 68 to apply a development bias and thereby a development bias is applied to the development roller 31 (S175) and instructs the transfer bias control unit 69 to apply a forward transfer bias and thereby a forward transfer bias is applied to the transfer roller 30 (S180).

After the CPU 60 has waited until the feed sensor 65 detects a trailing edge of the sheet 3 ("NO" at S185), when the feed sensor 65 detects a trailing edge of the sheet 3 ("YES" at S185), the CPU 60 instructs the laser emission control unit 67 to stop the exposure and thereby the exposure stops (S190). Subsequently, the CPU 60 instructs the development bias control unit 68 to cancel the development bias and thereby the development bias applied to the development roller 31 is canceled (S195) and instructs the transfer bias control unit 69 to cancel the forward transfer bias (i.e., set the forward transfer bias to 0 volt) and thereby the forward transfer bias applied to the transfer roller 30 is canceled (S200) and then proceeds again to the aforementioned S155.

If, at S155, the images for the received image data are all printed ("YES" at S155), the CPU 60 then waits for a predetermined period of time required for discharging of a sheet 3 to be completed (S205). The CPU 60 then instructs the charging bias control unit 66 to cancel the charging bias and thereby the charger 29 is turned off, and instructs the main motor drive control unit 71 to stop the main motor and thereby the main motor is stopped (S210) and then the CPU 60 ends the process.

In the laser printer 1 according to the first embodiment described above, when charged toner is adhered to an electrostatic latent image from the development roller 31, a development current resulting from movement of the charged toner flows between the photosensitive drum 27 and the development roller 31. When the charging property of the toner is not degraded, such an amount of the charged toner that corresponds to the specified density is adhered to the electrostatic latent image, and thus, the magnitude of the development current flowing between the photosensitive drum 27 and the development roller 31 corresponds to the specified density.

However, when the charging property of the toner is degraded, since only such an amount of the toner that is lower than the amount corresponding to the specified density is adhered to the electrostatic latent image, the magnitude of the development current flowing between the photosensitive drum 27 and the development roller 31 is smaller than that corresponding to the specified density. In the laser printer 1 according to the first embodiment, an absolute value of a detection voltage Va that is generated for the specified density when the charging property of the toner is degraded is measured in advance and the measured value is set as the first threshold. Thus, upon performing the first printing process, a determination as to whether the charging property of the toner is degraded can be made with high accuracy, based on the absolute value of the detection voltage Va generated for the specified density.

In the laser printer 1 according to the first embodiment, upon performing exposure at the specified density, a backward transfer bias is applied to the transfer roller 30 to form, between the outer surface of the transfer roller 30 and surface of the photosensitive layer of the photosensitive drum 27, an electric field in an opposite direction to a direction in which toner adhered to the surface of the photosensitive layer is adhered to the outer surface of the transfer roller 30; thus, it is possible to prevent toner that is used for a determination of degradation of the charging property from being adhered to the outer surface of the transfer roller 30. This makes it possible to prevent, upon printing after the determination, the toner used for the determination from being transferred to a sheet 3.

In addition, in the laser printer 1 according to the first embodiment, before performing exposure at the specified density (i.e., after a transfer to the last sheet 3), a development bias applied to the development roller 31 is canceled and thereby toner remained on the surface of the photosensitive layer of the photosensitive drum 27 is collected. Thus, it is possible to prevent error from occurring in the determination due to the toner remained on the surface of the photosensitive layer of the photosensitive drum 27.

In the laser printer 1 according to the first embodiment, the specified density is set to 100 percent and thus a non-exposed portion is not formed in a region to be exposed; accordingly, a detection voltage Va is not affected by a current (current resulting from a development bias) that flows between a non-exposed portion and the development roller 31, making it possible to determine with higher accuracy whether the charging property is degraded.

Moreover, in the laser printer 1 according to the first embodiment, an absolute value of a detection voltage Va that is generated for the specified density when the amount of remaining toner is short is measured in advance and the measured value is set as the second threshold. Thus, upon performing the first printing process, a determination as to whether the amount of remaining toner is short can be made with high accuracy, based on the absolute value of the detection voltage Va generated for the specified density.

Although, in the first embodiment, toner is collected by the development roller 31, a means for collecting toner during a period of time from a transfer step to an exposure step may be additionally provided.

In the first embodiment, the photosensitive layer of the photosensitive drum 27 is equivalent to a photosensitive element in the present invention, the charger 29, the charging bias control unit 66, and S100 of the first printing process are equivalent to a charging unit in the present invention, and the scanner unit 16 and the laser emission control unit 67 are equivalent to an exposing unit in the present invention. The development roller 31 is equivalent to a development member in the present invention, toner is equivalent to a developer in the present invention, and the development bias control unit 68 and S175 of the first printing process are equivalent to a developing unit in the present invention.

In the first embodiment, the sheet 3 is equivalent to a recording medium in the present invention, the transfer roller 30 is equivalent to a transfer member in the present invention, and the transfer bias control unit 69 and S180 of the first printing process are equivalent to a transferring unit in the present invention. S110 of the first printing process is equivalent to an exposure instructing unit in the present invention, the development current sensor 64, the current-measuring resistor 641, and S125 of the first printing process are equivalent to a measuring unit in the present invention, and S145 of the first printing process is equivalent to a degradation determining unit in the present invention.

In the first embodiment, the transfer bias control unit 69 and S120 of the first printing process are equivalent to a bias switching unit in the present invention, the development roller 31, the development bias control unit 68, and S105 and S130 of the first printing process are equivalent to a collecting unit in the present invention, S105 of the first printing process is equivalent to an operating unit in the present invention, and S135 of the first printing process is equivalent to a remaining amount shortage determining unit in the present invention. S100 of the first printing process is equivalent to a charging step in the present invention, S110 of the first printing process is equivalent to an exposing step in the present invention, S115 of the first printing process is equivalent to a bias applying step in the present invention, S125 of the first printing process is equivalent to a measuring step in the present invention, and S145 of the first printing process is equivalent to a degradation determining step in the present invention.

Second Embodiment

Now, a second embodiment will be described.

The second embodiment is an embodiment in which the specified density is set to 0 percent. A laser printer 1 according to the second embodiment is different from that according to the first embodiment in that the CPU 60 performs a second printing process (described later) instead of the first printing process and a determination process; otherwise, the configuration is exactly the same as that in the first embodiment. Hence, only the second printing process and the determination process will be described here.

Figure 6A:
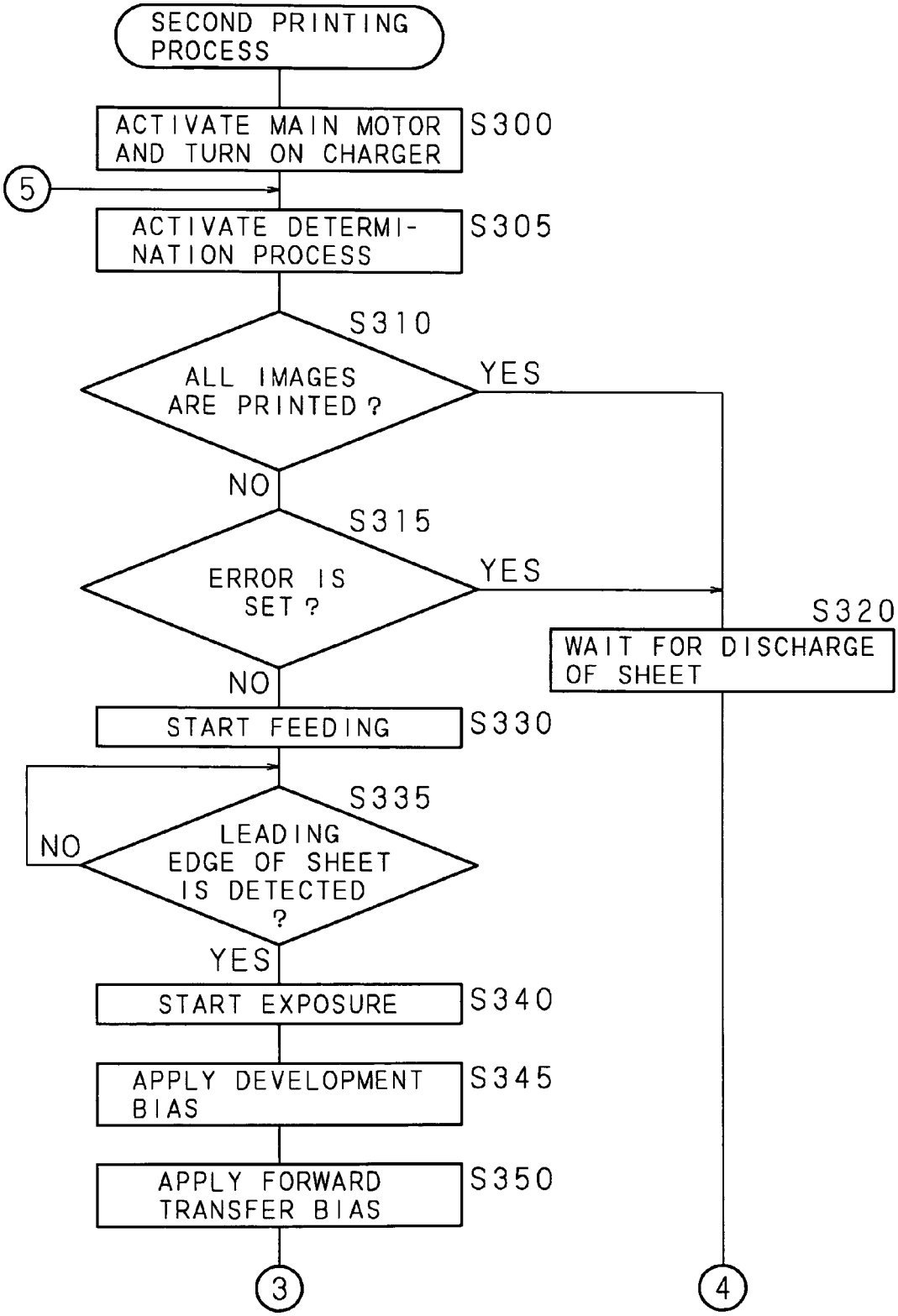
FIGS. 6A and 6B are flowcharts showing a flow of a second printing process.
Figure 6B:
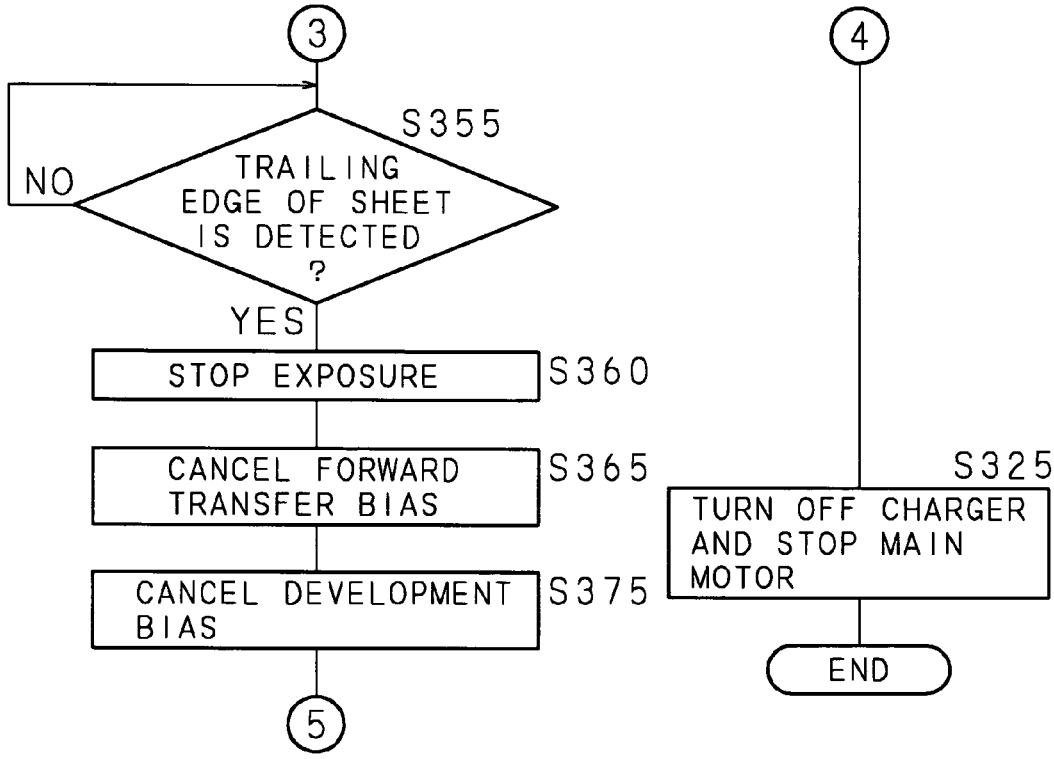

FIGS. 6A and 6B are flowcharts showing a flow of the second printing process. The CPU 60 performs this process when receiving image data from an external terminal device.

In the process, first, as with S100 of the first printing process, the CPU 60 instructs the main motor drive control unit 71 to activate the main motor and thereby the main motor is activated, and instructs the charging bias control unit 66 to apply a charging bias and thereby the charger 29 is turned on (S300), whereby the photosensitive layer of the photosensitive drum 27 is charged while the photosensitive drum 27 is rotated. Subsequently, the CPU 60 activates a determination process which will be described later (S305) and then as with S155 of the first printing process, the CPU 60 determines whether images for the received image data are all printed (S310). If the images are all printed ("YES" at S310), the CPU 60 then proceeds to S320 which will be described later. On the other hand, if the images are not all printed ("NO" at S310), the CPU 60 then determines whether occurrence of error is set in the RAM 62 (S315).

If occurrence of error is set ("YES" at S315), as with S205 of the first printing process, the CPU 60 then waits for a predetermined period of time required for discharging of a sheet 3 to be completed (S320). Then, as with S210 of the first printing process, the CPU 60 instructs the charging bias control unit 66 to cancel the charging bias and thereby the charger 29 is turned off, and instructs the main motor drive control unit 71 to stop the main motor and thereby the main motor is stopped (S325) and then the CPU 60 ends the process.

If, at S315, occurrence of error is not set in the RAM 62 ("NO" at S315), the CPU 60 performs the same processes as those of S160 to S190 of the first printing process. Specifically, the CPU 60 instructs the feed mechanism control unit 72 to allow the feed mechanisms to operate and thereby feeding starts (S330). Then, after the CPU 60 has waited until the feed sensor 65 detects a leading edge of a sheet 3 ("NO" at S335), when the feed sensor 65 detects a leading edge of a sheet 3 ("YES" at S335), the CPU 60 instructs the laser emission control unit 67 to perform exposure according to the image data and thereby exposure starts (S340).

After a certain period of time has elapsed after the exposure is started, the CPU 60 instructs the development bias control unit 68 to apply a development bias and thereby a development bias is applied to the development roller 31 (S345) and instructs the transfer bias control unit 69 to apply a forward transfer bias and thereby a forward transfer bias is applied to the transfer roller 30 (S350). Then, after the CPU 60 has waited until the feed sensor 65 detects a trailing edge of the sheet 3 ("NO" at S355), when the feed sensor 65 detects a trailing edge of the sheet 3 ("YES" at S355), the CPU 60 instructs the laser emission control unit 67 to stop the exposure and thereby the exposure stops (S360). The CPU 60 instructs the transfer bias control unit 69 to cancel the forward transfer bias and thereby the forward transfer bias applied to the transfer roller 30 is canceled (S365), and instructs the development bias control unit 68 to cancel the development bias and thereby the development bias applied to the development roller 31 is canceled (S375), and proceeds again to the aforementioned S305.

Figure 7:
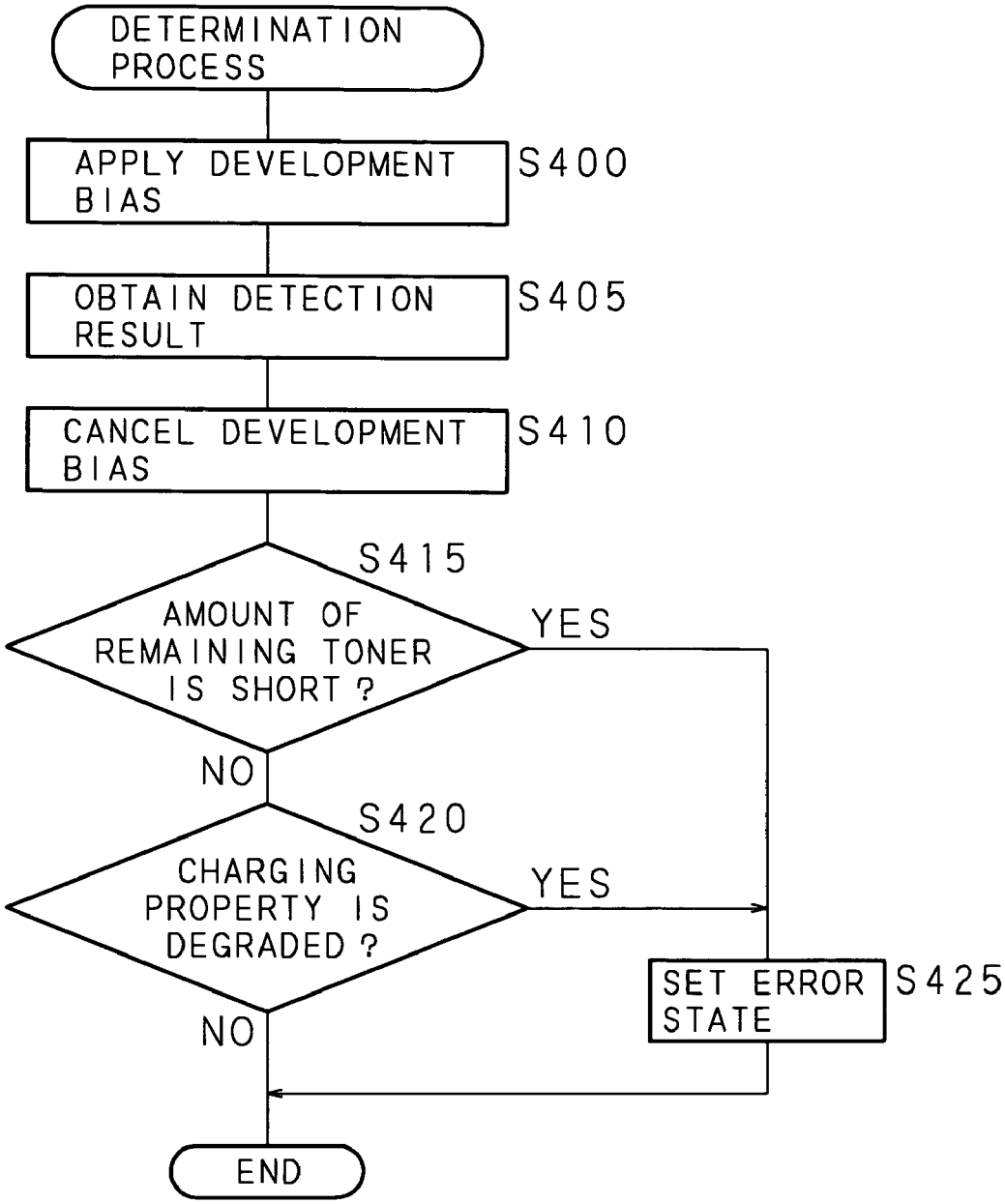
FIG. 7 is a flowchart showing a flow of a determination process.

FIG. 7 is a flowchart showing a flow of the determination process activated at the aforementioned S305. Note that since, as described above, the CPU 60 is set to be able to perform multitasking, the determination process is performed in parallel with the second printing process.

In the process, first, the CPU 60 instructs the development bias control unit 68 to apply a development bias and thereby a development bias is applied to the development roller 31 (S400). Thereafter, the CPU 60 obtains a detection result (absolute value of a detection voltage Va) by the development current sensor 64 (S405) and stores the obtained detection result in the RAM 62. Here, the detection result is obtained at arbitrary timing. When the obtaining of the detection result is completed, the CPU 60 instructs the development bias control unit 68 to cancel the development bias and thereby the development bias applied to the development roller 31 is canceled (S410).

The CPU 60 determines whether the absolute value of the detection voltage Va which is stored in the RAM 62 at S405 is less than a second threshold which is set in advance in the ROM 61, and thereby determines whether the amount of remaining toner is short (S415). Here, an absolute value of a detection voltage Va which is generated when a development bias is applied to the development roller 31 without exposing the photosensitive layer of the photosensitive drum 27 at all and with the amount of remaining toner being short, is measured in advance and the measured value is set in the ROM 61 as the second threshold. The second threshold is smaller than a first threshold which will be described later.

If it is determined that the amount of remaining toner is short ("YES" at S415), the CPU 60 then proceeds to S425 which will be described later. On the other hand, if it is determined that the amount of remaining toner is not short ("NO" at S415), the CPU 60 then determines whether the absolute value of the detection voltage Va stored in the RAM 62 is less than the first threshold set in advance in the ROM 61, and thereby determines whether the charging property of toner is degraded (S420). Here, an absolute value of a detection voltage Va which is generated when a development bias is applied to the development roller 31 without exposing the photosensitive layer of the photosensitive drum 27 at all and with the charging property of the toner being degraded, is measured in advance and the measured value is set in the ROM 61 as the first threshold.

If it is determined that the charging property of the toner is not degraded ("NO" at S420), the CPU 60 then immediately ends the process. On the other hand, if it is determined that the charging property of the toner is degraded ("YES" at S420), the CPU 60 then sets occurrence of error in the RAM 62 (S425) and then ends the process. Note that if the determination process does not end by the time S315 of the second printing process is performed (the determination process is not in time), printing is performed on a single sheet 3 but it is also fine.

In the laser printer 1 according to the second embodiment described above, a determination as to whether the charging property of toner is degraded is made by utilizing the fact that when the toner acts as electrical resistance and the charging property of the toner is degraded, the electrical resistance increases and a development current that flows between the photosensitive drum 27 and the development roller 31 decreases.

In the laser printer 1 according to the second embodiment, an absolute value of a detection voltage Va which is generated when the charging property of toner is degraded without exposing the photosensitive drum 27 at all (i.e., the specified density is 0 percent) is measured in advance and the measured value is set as the first threshold. Thus, upon a determination process, a determination as to whether the charging property of the toner is degraded can be made with high accuracy, based on the absolute value of the detection voltage Va. In addition, since upon the determination process an electrostatic latent image is not formed on the surface of the photosensitive layer of the photosensitive drum 27, the detection voltage Va is not affected by a current resulting from movement of the toner, making it possible to determine with higher accuracy whether the charging property is degraded.

Moreover, without consuming toner, degradation of the charging property of the toner can be determined and thus it is possible to prevent unnecessary consumption of the toner. Furthermore, since there is no need to collect toner in a determination process, printing can be performed instantly and there is no need to set a process of collecting toner in the determination process. That is, the determination process can be simplified. By this, even when printing is continuously performed on a plurality of sheets 3, it becomes possible to make a determination at an interval between the sheets (a non-printing section between the sheets 3) and thus it is possible to prevent printing from being continuously performed despite the fact that the charging property is degraded.

In the second embodiment, the charger 29, the charging bias control unit 66, and S300 of the second printing process are equivalent to a charging unit, the development bias control unit 68 and S345 of the second printing process are equivalent to a developing unit, and the transfer bias control unit 69 and S350 of the second printing process are equivalent to a transferring unit. The development current sensor 64, the current-measuring resistor 641, and S405 of the determination process are equivalent to a measuring unit, S420 of the determination process is equivalent to a degradation determining unit, and S415 of the determination process is equivalent to a remaining amount shortage determining unit. S300 of the second printing process is equivalent to a charging step, S400 of the determination process is equivalent to a bias applying step, S405 of the determination process is equivalent to a measuring step, and S420 of the determination process is equivalent to a degradation determining step.

EXAMPLE

To determine a detection voltage Va to be set as the first threshold in the first and the second embodiments, the inventor conducted a measurement experiment to measure a development current. In the measurement experiment, HL-1850 manufactured by Brother Industries, Ltd. was used as a laser printer, DR-500 manufactured by the same company is used as a drum unit, and TN-560 manufactured by the same company was used as a development unit. In the measurement experiment, a development current was measured with the specified density being set to 100 percent and 0 percent.

Figure 8:
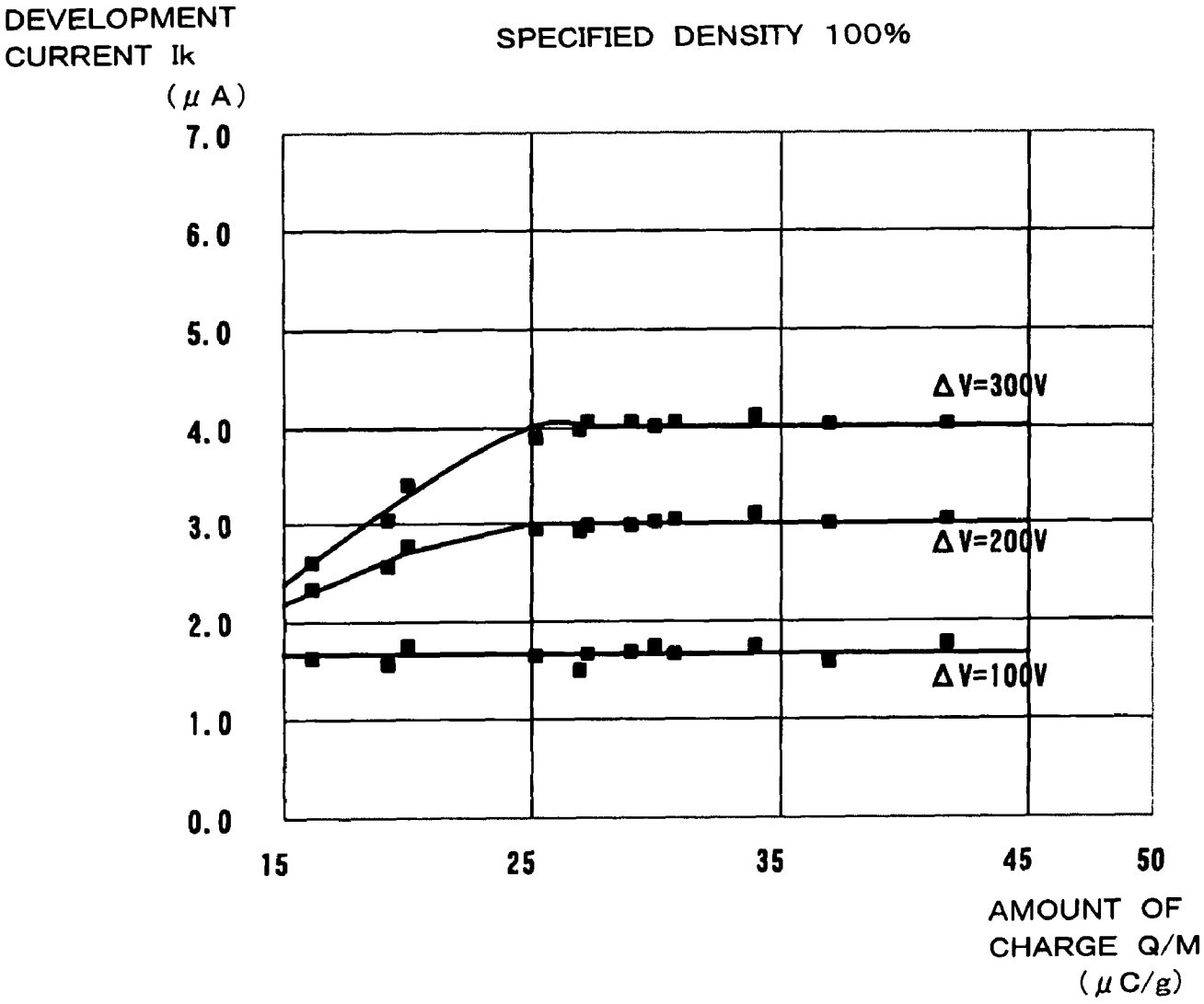
FIG. 8 is a graph showing transition of the development current when a specified density is set to 100 percent.

FIG. 8 is a graph showing the transition of a development current when the specified density is set to 100 percent. In the measurement experiment, a development current was measured such that 100 percent exposure was performed on a region of a surface of a photosensitive layer of a photosensitive drum which is 20 millimeters in a rotating direction of the photosensitive drum and 190 millimeters in a direction of a rotating shaft of the photosensitive drum, and the difference ($\Delta V$) between a charging bias and a development bias was set to 100 volts, 200 volts, and 300 volts. As shown in FIG. 8, for the specified density of 100 percent, although a certain magnitude of the development current was maintained until the amount of charge on toner was reduced to a certain value (25 $\mu C/g$), once the amount of charge on the toner was reduced lower than the certain value, the magnitude of the development current was rapidly reduced (when $\Delta V$=200 volts and 300 volts).

In view of these measurement results, the inventor set the first threshold as follows. When a determination as to whether the charging property was degraded was made with $\Delta V$ being 300 volts and by performing 100 percent exposure on the 20 mm×190 mm region of the surface of the photosensitive layer of the photosensitive drum, a detection voltage Va which was calculated by adding up an electrical resistance of a current-measuring resistor to the development current of 3.3 micro amperes was set as the first threshold.

Figure 9:
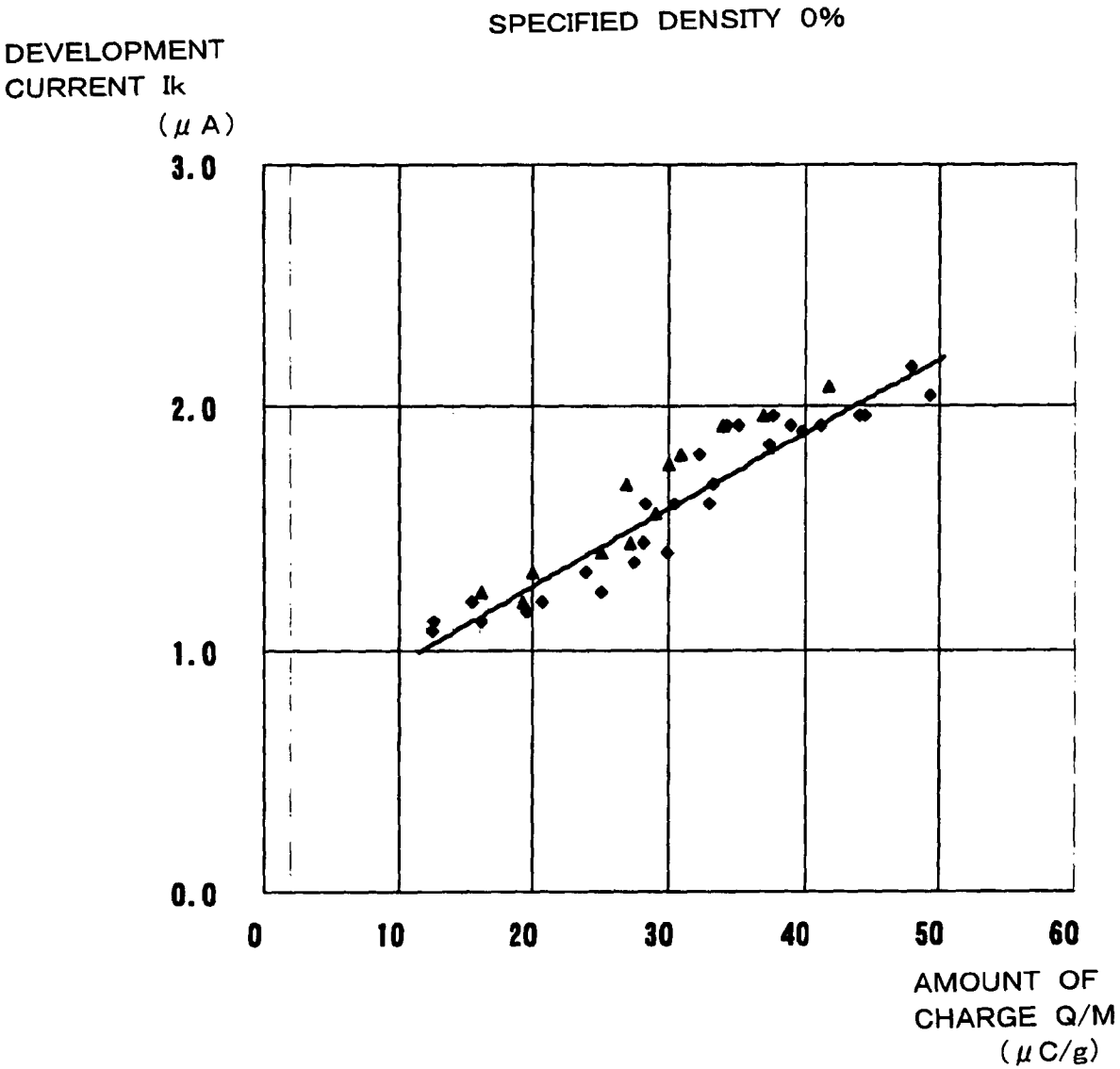
FIG. 9 is a graph showing transition of the development current when the specified density is set to 0 percent.

FIG. 9 is a graph showing the transition of a development current when the specified density is set to 0 percent. In the measurement experiment, a development current was measured with a development bias being set to +300 volts and a charging bias being set to +880 volts.

As shown in FIG. 9, for the specified density of 0 percent, the development current was reduced with a reduction in the amount of charge on toner. In view of the measurement results, the inventor set the first threshold as follows. When a determination as to whether the charging property was degraded was made with the development bias being +300 volts and the charging bias being +880 volts and without performing exposure on the photosensitive drum at all, a detection voltage Va which was calculated by adding up an electrical resistance of the current-measuring resistor to the development current of 1.1 micro amperes was set as the first threshold.

Figure 10:
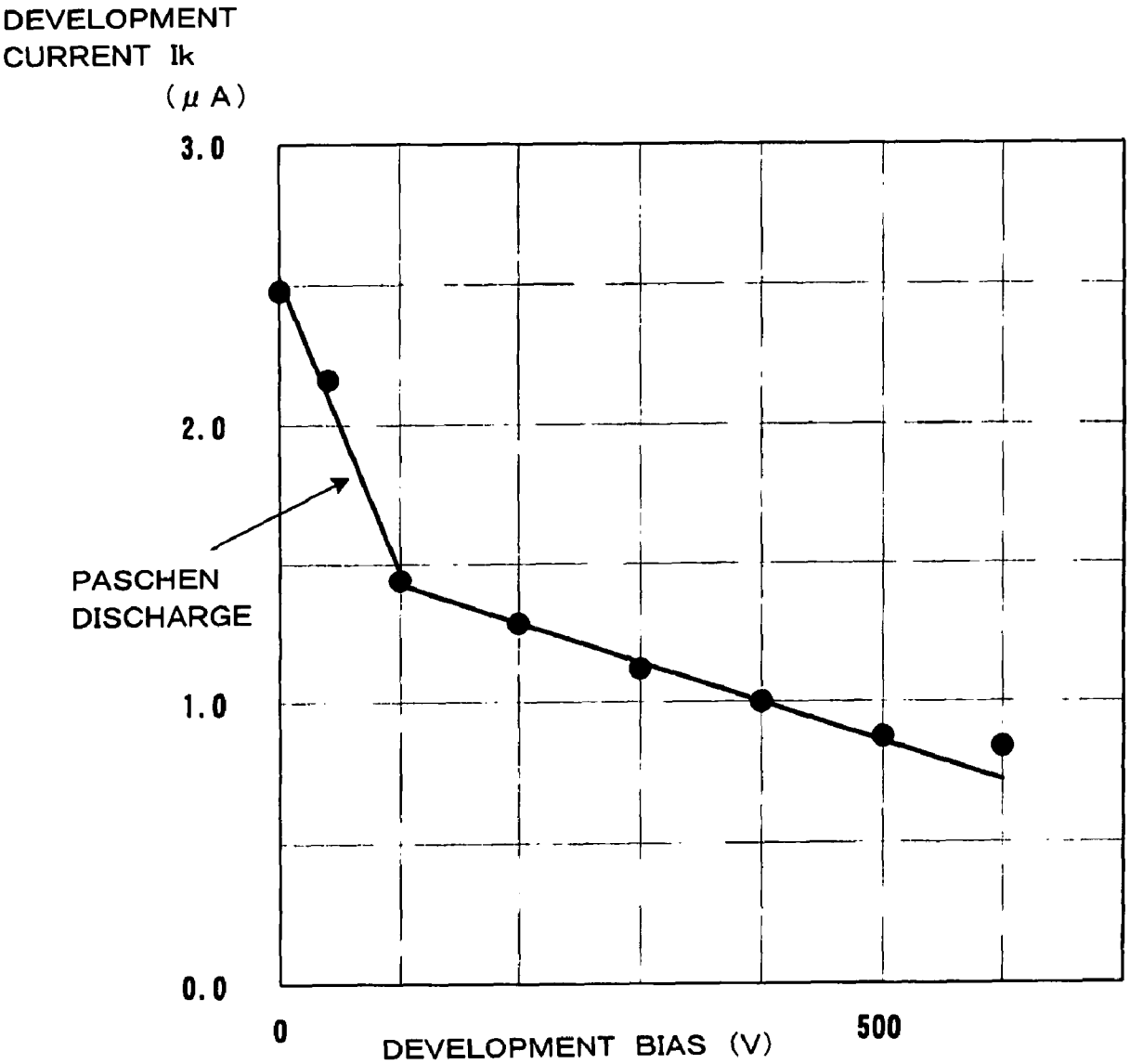
FIG. 10 is a graph showing transition of the development current relative to a development bias.

Note that when a measurement experiment is conducted with the specified density being set to 0 percent, if a development bias is made too low over a charging bias (i.e., ΔV is made too high), Paschen discharge occurs between the development roller and the surface of the photosensitive layer of the photosensitive drum; as a result, measurement results do not depend on the electrical resistance of the toner (see FIG. 10). Accordingly, it is desirable that a measurement experiment be conducted by applying to the development roller a development bias with a magnitude at which Paschen discharge does not occur.

Reference Example

Figure 11:
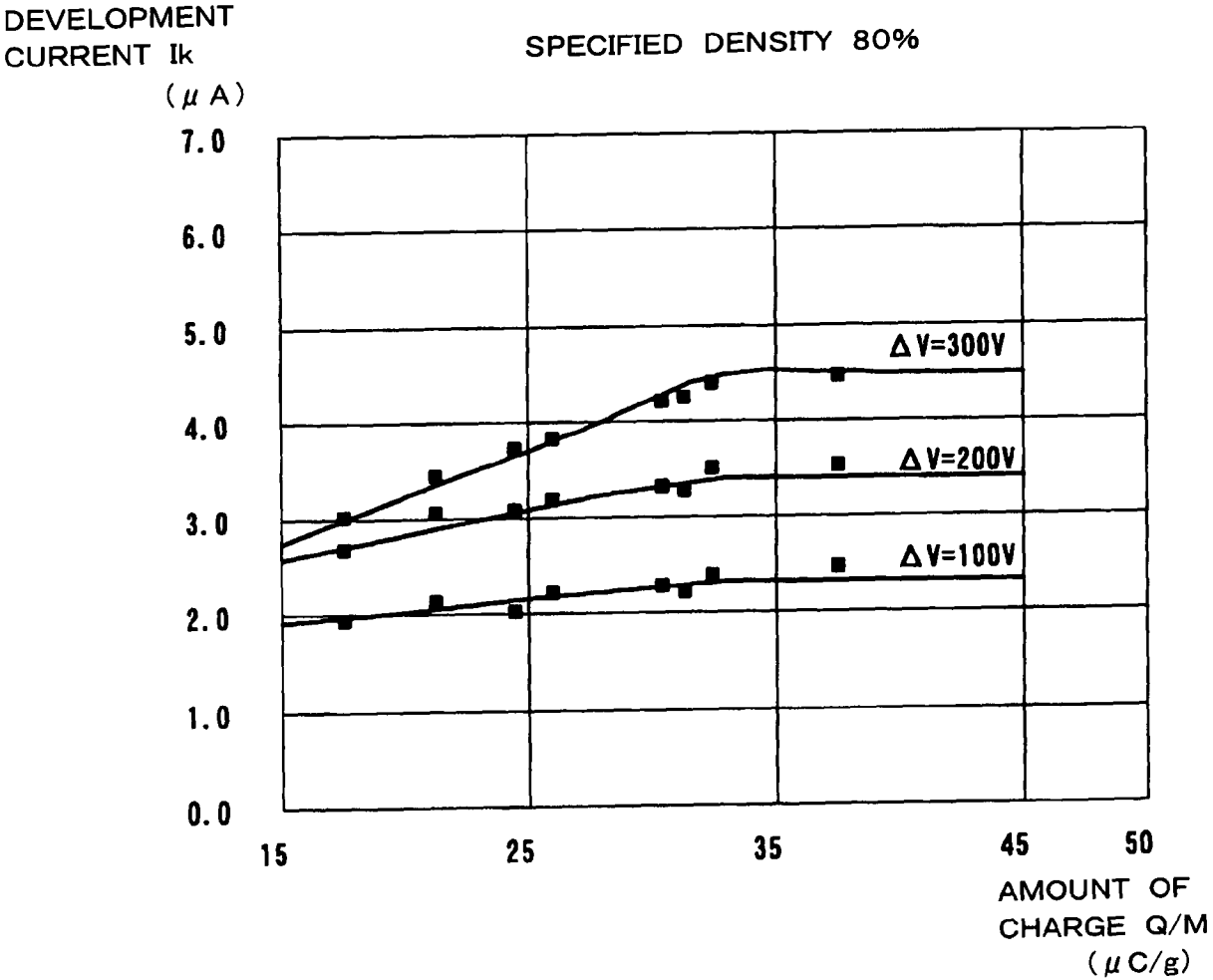
FIG. 11 is a graph showing transition of the development current when the specified density is set to 80 percent.

For reference, the inventor measured a development current with the specified density being set to 80 percent (note that the size of an exposed region and ΔV are the same as those for the specified density of 100 percent) and results as shown in FIG. 11 are obtained.

Specifically, when the specified density was set to 80 percent, as with when the specified density was set to 100 percent, although a certain magnitude of the development current was maintained until the amount of charge on toner was reduced to a certain value, once the amount of charge on the toner was reduced lower than the certain value, the magnitude of the development current was rapidly reduced (when ΔV=200 volts and 300 volts). However, the certain value is greater than that obtained when the specified density is set to 100 percent; thus, taking into account this fact, the first threshold needs to be set when a determination as to whether the charging property is degraded is made by performing 80 percent exposure on the aforementioned region.

Although the embodiments of the present invention have been described above, it is to be understood that the present invention is not limited thereto and various embodiments can be implemented as long as the embodiments fall within the technical scope of the present invention.

For example, although in the foregoing embodiments the laser printer 1 uses toner having a positive charging property, toner having a negative charging property may be used. In addition, although the specified density is set to 100 percent and 0 percent, the specified density may, of course, be set to any other rate.

Although in the foregoing embodiments the charging property of toner is determined to be degraded when the absolute value of a detection voltage Va is less than the first threshold, the charging property of toner may be determined to be degraded when the absolute value of a detection voltage Va is equal to or less than the first threshold.

Although in the foregoing embodiments the amount of remaining toner is determined to be short when the absolute value of a detection voltage Va is less than the second threshold, the amount of remaining toner may be determined to be short when the absolute value of a detection voltage Va is equal to or less than the second threshold.

Although in the foregoing embodiments the first threshold and the second threshold are voltage values, the first threshold and the second threshold may be current values. In this case, the CPU 60 calculates a development current based on the aforementioned equation (1) by using an absolute value of a detection voltage Va outputted from the development current sensor 64.

Although in the foregoing embodiments toner adhered to the photosensitive layer of the photosensitive drum 27 is adhered to the development roller 31 and collected, the toner may be adhered to the transfer roller 30 and collected, or an intermediate transfer element (an intermediate transfer roller or intermediate transfer belt) may be provided to the laser printer 1 and the toner may be adhered to the intermediate transfer element and collected.

Although in the foregoing embodiments by canceling a development bias applied to the development roller 31, toner is adhered to the development roller 31 and collected, the development bias control unit 68 capable of applying to the development roller 31 a bias (voltage) that allows the development roller 31 to have a potential lower than a charging potential of the photosensitive layer of the photosensitive drum 27 may be configured and by actively applying such a bias to the development roller 31 upon collecting toner, the toner may be adhered to the development roller 31 and collected.

Although in the foregoing embodiments the present invention is applied to a laser printer that scans a laser beam and exposes a surface of a photosensitive layer of a photosensitive drum, the present invention may, of course, be applied to a so-called LED printer in which a surface of a photosensitive layer is exposed by a plurality of LEDs arranged in parallel along a rotating shaft of a photosensitive drum. In addition, the present invention may, of course, be applied to other image forming apparatuses such as copying apparatuses and multifunctional apparatuses.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within metes and bounds of the claims, or equivalence of such metes and bounds thereof are therefore intended to be embraced by the claims.

What is claimed is:

1. An image forming apparatus comprising:

a photosensitive element;

a charging unit that charges the photosensitive element;

an exposing unit that irradiates light onto a surface of the photosensitive element charged by the charging unit to expose the surface of the photosensitive element and forms an electrostatic latent image on the surface of the photosensitive element;

a developing unit that allows a developer having a charging property to be adhered to a development member that comes into contact with the surface of the photosensitive element, and applies to the development member a development bias to form, between the development member and the surface of the photosensitive element, an electric field in a direction in which the developer is adhered to the electrostatic latent image, whereby the developer is adhered to the electrostatic latent image and the electrostatic latent image is developed as a developer image;

a transferring unit that transfers the developer image onto a recording medium and forms an image on the recording medium;

an exposure instructing unit that allows the exposing unit to perform exposure on the surface of the charged photosensitive element at a specified density which is specified in advance;

a measuring unit that measures a magnitude of a current that flows between the photosensitive element and the development member;

a degradation determining unit that determines that a charging property of the developer is degraded when a value measured by the measuring unit is less than a first threshold which is set in advance; and a remaining amount shortage determining unit that determines that an amount of remaining developer is short when the value measured by the measuring unit is less than a second threshold, the second threshold being set in advance and being smaller than the first threshold.

2. The image forming apparatus according to claim 1, wherein the transferring unit has a transfer member that faces the surface of the photosensitive element, a forward transfer bias is applied to the transfer member to form, between the transfer member and the surface of the photosensitive element, an electric field in a direction in which the developer adhered to the surface of the photosensitive element is adhered to the transfer member, and said image forming apparatus further comprises a bias switching unit that applies, upon an operation of the exposure instructing unit, to the transfer member a backward transfer bias, instead of the forward transfer bias, to form, between the transfer member and the surface of the photosensitive element, an electric field in an opposite direction to the electric field formed by the forward transfer bias.

3. The image forming apparatus according to claim 1, further comprising:

a collecting unit that collects a portion of the developer that is adhered to the surface of the photosensitive element, after the transfer to the recording medium; and an operating unit that allows the exposure instructing unit to operate after the collection of the developer by the collecting unit.

4. The image forming apparatus according to claim 1, wherein the specified density is 100 percent.

5. The image forming apparatus according to claim 1, wherein the specified density is 0 percent.

6. An image forming apparatus comprising:

a photosensitive element;

a charging unit that charges the photosensitive element;

an exposing unit that irradiates light onto a surface of the photosensitive element charged by the charging unit to expose the surface of the photosensitive element and forms an electrostatic latent image on the surface of the photosensitive element;

a developing unit that allows a developer having a charging property to be adhered to a development member that comes into contact with the surface of the photosensitive element, and applies to the development member a development bias to form, between the development member and the surface of the photosensitive element, an electric field in a direction in which the developer is adhered to the electrostatic latent image, whereby the developer is adhered to the electrostatic latent image and the electrostatic latent image is developed as a developer image;

a transferring unit that transfers the developer image onto a recording medium and forms an image on the recording medium;

an exposure instructing unit that allows the exposing unit to perform exposure on the surface of the charged photosensitive element at a specified density which is specified in advance;

a measuring unit that measures a magnitude of a current that flows between the photosensitive element and the development member;

a degradation determining unit that determines that a charging property of the developer is degraded when a value measured by the measuring unit is equal to or less than a first threshold which is set in advance; and a remaining amount shortage determining unit that determines that an amount of remaining developer is short when the value measured by the measuring unit is equal to or less than a second threshold, the second threshold being set in advance and being smaller than the first threshold.

7. The image forming apparatus according to claim 6, wherein the transferring unit has a transfer member that faces the surface of the photosensitive element, a forward transfer bias is applied to the transfer member to form, between the transfer member and the surface of the photosensitive element, an electric field in a direction in which the developer adhered to the surface of the photosensitive element is adhered to the transfer member, and said image forming apparatus further comprises a bias switching unit that applies, upon an operation of the exposure instructing unit, to the transfer member a backward transfer bias, instead of the forward transfer bias, to form, between the transfer member and the surface of the photosensitive element, an electric field in an opposite direction to the electric field formed by the forward transfer bias.

8. The image forming apparatus according to claim 6, further comprising:

a collecting unit that collects a portion of the developer that is adhered to the surface of the photosensitive element, after the transfer to the recording medium; and an operating unit that allows the exposure instructing unit to operate after the collection of the developer by the collecting unit.

9. The image forming apparatus according to claim 6, wherein the specified density is 100 percent.

10. The image forming apparatus according to claim 6, wherein the specified density is 0 percent.

11. A method of determining degradation of a charging property of a developer comprising:

a charging step of charging a photosensitive element;

an exposing step of exposing a surface of the charged photosensitive element at a specified density which is specified in advance, and forming an electrostatic latent image on the surface;

a bias applying step of allowing a developer having a charging property to be adhered to a development member that comes into contact with the surface of the photosensitive element, and applying to the development member a development bias to form, between the development member and the surface of the photosensitive element, an electric field in a direction in which the developer is adhered to the electrostatic latent image;

a measuring step of measuring a magnitude of a current that flows between the photosensitive element and the development member;

a degradation determining step of determining whether a measurement result in the measuring step is less than a first threshold which is set in advance, and determining that a charging property of the developer is degraded when the measurement result is less than the first threshold; and a remaining amount shortage determining unit that determines that an amount of remaining developer is short when the value measured by the measuring unit is less than a second threshold, the second threshold being set in advance and being smaller than the first threshold.

12. A method of determining degradation of a charging property of a developer comprising:

a charging step of charging a photosensitive element;

an exposing step of exposing a surface of the charged photosensitive element at a specified density which is specified in advance, and forming an electrostatic latent image on the surface;

a bias applying step of allowing a developer having a charging property to be adhered to a development member that comes into contact with the surface of the photosensitive element, and applying to the development member a development bias to form, between the development member and the surface of the photosensitive element, an electric field in a direction in which the developer is adhered to the electrostatic latent image;

a measuring step of measuring a magnitude of a current that flows between the photosensitive element and the development member;

a degradation determining step of determining whether a measurement result in the measuring step is equal to or less than a first threshold which is set in advance, and determining that a charging property of the developer is degraded when the measurement result is equal to or less than the first threshold; and a remaining amount shortage determining unit that determines that an amount of remaining developer is short when the value measured by the measuring unit is equal to or less than a second threshold, the second threshold being set in advance and being smaller than the first threshold.

* * * * *